US006572403B2

(12) United States Patent
Reimund et al.

(10) Patent No.: US 6,572,403 B2
(45) Date of Patent: Jun. 3, 2003

(54) EXPANSION PLUG APPARATUS FOR CONNECTING A PLURALITY OF TERMINAL BLOCKS

(75) Inventors: Jim Reimund, Georgetown, TX (US); Jim Koughan, Liberty Hill, TX (US)

(73) Assignee: National Instruments Corporation, Austin, TX (US)

( * ) Notice: Subject to any disclaimer, the term of this patent is extended or adjusted under 35 U.S.C. 154(b) by 0 days.

(21) Appl. No.: 09/767,572

(22) Filed: Jan. 22, 2001

(65) Prior Publication Data

US 2002/0098719 A1 Jul. 25, 2002

(51) Int. Cl.[7] ..... H01R 31/08
(52) U.S. Cl. ..... 439/507
(58) Field of Search ..... 439/507, 511, 439/512; 361/753, 797, 803, 823

(56) References Cited

U.S. PATENT DOCUMENTS

| | | | | |
|---|---|---|---|---|
| 4,171,861 A | | 10/1979 | Hohorst | |
| 4,384,754 A | * | 5/1983 | Douty et al. | 439/74 |
| 4,511,950 A | * | 4/1985 | Bunner et al. | 361/413 |
| 4,658,375 A | * | 4/1987 | Onogi et al. | 364/900 |
| 4,950,178 A | * | 8/1990 | Harvey et al. | 439/507 |
| 5,321,203 A | * | 6/1994 | Goto et al. | 174/48 |
| 5,343,361 A | * | 8/1994 | Rudy, Jr. et al. | 361/710 |
| 5,651,702 A | | 7/1997 | Hanning et al. | |
| 5,716,241 A | | 2/1998 | Hennemann et al. | |
| 5,722,862 A | | 3/1998 | Glathe et al. | |
| 5,740,020 A | * | 4/1998 | Palatov | 361/796 |
| 5,741,142 A | | 4/1998 | Dux et al. | |
| 5,774,343 A | * | 6/1998 | Benson et al. | 361/796 |
| 6,027,379 A | | 2/2000 | Hohorst | |
| 6,058,025 A | * | 5/2000 | Ecker et al. | 361/816 |
| 6,166,919 A | * | 12/2000 | Nicolici et al. | 361/800 |
| 6,169,662 B1 | * | 1/2001 | Clark et al. | 361/754 |
| 6,241,561 B1 | | 6/2001 | Zebermann et al. | |
| 6,243,273 B1 | * | 6/2001 | Beun et al. | 361/796 |
| 6,272,021 B1 | * | 8/2001 | Nagamine et al. | 361/796 |
| 6,392,319 B1 | | 5/2002 | Zebermann et al. | |

OTHER PUBLICATIONS

"Feed–Through and Protective Conductor Terminal Blocks," Z–Roof Datasheet, Weidmuller, May 2, 12 pages.
"PM2.5(G)—Din Rail Connector/Standard Terminal Blocks" Dinkle, 1 page from the Web dated Jul. 30,2002.

* cited by examiner

*Primary Examiner*—Tulsidas Patel
*Assistant Examiner*—Thanh-Tam Le
(74) *Attorney, Agent, or Firm*—Meyertons Hood Kivlin Kowert & Goetzel, P.C.; Jeffrey C. Hood

(57) ABSTRACT

A system and method for connecting a plurality of terminal blocks. An expansion plug includes a first connector and a second connector which are electrically connected to each other. Each terminal block includes at least one plug connector to couple to one of the two connectors of the expansion plug, and may include both a top plug connector and a bottom plug connector to couple to a neighboring terminal block via the expansion plug using either top plug connectors or bottom plug connectors. Each of the plurality of terminal blocks couples to a corresponding switching module to form a plurality of switch matrices. Successive terminal block pairs are coupled via top and bottom plug connectors in an alternating manner, thus coupling any number of terminal block/module pairs together via expansion plugs in an interleaved manner, such that the plurality of switch matrices are integrated into a single integrated switch matrix.

37 Claims, 5 Drawing Sheets

EXPANSION PLUG APPARATUS FOR CONNECTING A PLURALITY OF TERMINAL BLOCKS

FIELD OF THE INVENTION

The present invention relates to data acquisition and measurement, and in particular to an expansion plug apparatus for connecting multiple terminal blocks in a data acquisition or measurement device chassis.

DESCRIPTION OF THE RELATED ART

Currently most engineers and scientists use personal or industrial computers (PCs) with expansion buses for laboratory research, industrial control, test, and measurement systems. Such systems may be referred to generally as Data Acquisition (DAQ) systems. Typically, such systems include a personal or industrial host computer, one or more transducers, signal conditioning logic or software, measurement hardware, and software. Transducers convert physical phenomena into electrical signals. For example, thermocouples and thermistors convert temperature into a voltage or resistance, respectively. Other examples of transducers include strain gauges, flow transducers, and pressure transducers, which convert force, rate of flow, and pressure to electrical signals, respectively.

In many DAQ systems, the DAQ hardware is comprised on a card installed in the host computer. Cables may couple the DAQ hardware directly to sensors, transducers, or a Unit Under Test (UUT), or to intervening hardware such as a signal conditioning device, which is in turn coupled to the UUT.

Transducer outputs must often be conditioned by signal conditioning logic to provide signals suitable for input to a measurement device. Signal conditioning logic may take many forms, including dedicated switching modules, or conditioning logic built into the measurement device, e.g., digital multimeters and probes used with oscilloscopes. Signal conditioning logic or software may amplify low-level signals, isolate, filter, excite, and/or provide bridge completion to produce appropriate signals for the measurement device.

Measurement hardware typically includes a signal digitizer which is operable to receive analog signals from one or more transducers or signal conditioners, and convert the analog signals into digital form via sampling.

DAQ systems generally include software as well, such as driver software and application software. DAQ system driver software typically comprises a software library that directly programs the registers of the measurement hardware, managing its operation and its integration with computer resources, such as processor interrupts, direct memory access (DMA), and memory. Driver software hides the low-level, complicated details of hardware programming while preserving high performance. Application software provides an efficient way to program measurement hardware. One exemplary system used to develop application software is National Instruments' LabVIEW graphical programming environment. Application software may add analysis and presentation capabilities to the driver software, and may also integrate instrument control, such as GPIB (General Purpose Instrument Bus), RS-232, PXI, and VXI, with computer-based measurement components.

Many DAQ hardware systems, including signal conditioning devices, typically take the form of one or more modules in a chassis. Each module typically interfaces to an external signal source, such as a transducer or UUT, through a terminal block. A terminal block provides a convenient method for connecting and disconnecting I/O signal wires or cables to a DAQ system. More specifically, a terminal block provides a simple and convenient interface to an individual module in a chassis through which wires or cables from one or more signal sources or other devices may be coupled.

Some DAQ tasks may require a great number of I/O connections, for example, to receive input from a great number of signal sources. In other words, it may be necessary to connect a large number of wires or cables to the data acquisition, measurement, or signal conditioning hardware, thereby exceeding the number of connections available for a given terminal block. Typically, in these cases, multiple terminal blocks/modules may be "daisy-chained" together via patch wires or cables, thereby forming a single integrated "super-module". For example, when each terminal block/module pair comprises a switching matrix, one or more of the terminal blocks may be daisy-chained together, thereby integrating the corresponding switch matrices together to form a single integrated switch matrix which is capable of receiving a great number of I/O connections. Furthermore, the integrated switch matrix facilitates the routing of signal paths to and from any of the corresponding modules from and to any of the interconnected terminal blocks.

However, when the number of input wires or cables and the number of interconnected modules are great, the wiring requirements become increasingly complex. Such complexity increases the chance for wiring errors during setup, and greatly increases the time and effort required to configure and re-configure the system. Furthermore, the use of many patch wires or cables presents a confusing and messy or unclean interface. Therefore, improved systems and methods are desired for interconnecting a plurality of terminal blocks.

SUMMARY OF THE INVENTION

A system and method for connecting multiple terminal blocks in a data acquisition or measurement device chassis are presented. According to one embodiment of the invention, an expansion plug may be adapted to connect the multiple terminal blocks. The expansion plug may include a housing which has a rectangular form factor, with at least two connectors comprised on one side of the expansion plug. In other embodiments the expansion plug may have other form factors, such as a square, oval, or any other suitable form factor. The expansion plug may have a shallow profile which accommodates rack-mount installation of the chassis in that no extra vertical rack space is required for the expansion plug.

In one embodiment, the expansion plug may include a first connector and a second connector which are electrically connected to each other, and which may be operable to couple the expansion plug to two adjacent terminal blocks. In a preferred embodiment, the first connector and the second connector are disposed on a first surface of the expansion plug housing.

In one embodiment, a first terminal block and an adjacent second terminal block may be coupled together by the expansion plug. Each of the terminal blocks includes at least one plug connector which is operable to couple to one of the two connectors of the expansion plug. In one embodiment, the first terminal block may comprise a first plurality of column connections, and the second terminal block may comprise a second plurality of column connections. The expansion plug may electrically couple the first terminal block to the second terminal block wherein each of the first plurality of column connections is electrically coupled to a corresponding one of the second plurality of column connections. Thus, the expansion plug may couple the first and second terminal blocks via the respective column connections of each terminal block.

In another embodiment, the first terminal block may comprise a first plurality of row connections, and the second terminal block may comprise a second plurality of row connections. The expansion plug may electrically couple the first terminal block to the second terminal block wherein each of the first plurality of row connections is electrically coupled to a corresponding one of the second plurality of row connections. Thus, the expansion plug may couple the first and second terminal blocks via the respective row connections of each terminal block.

In one embodiment, the plug connectors of the first and second terminal blocks may comprise top plug connectors which are located on a top edge of the terminal blocks. In this embodiment, the first connector of the expansion plug couples to the top plug connector of the first terminal block; and the second connector of the expansion plug couples to the top plug connector of the second terminal block.

In one embodiment, the second terminal block may also include a bottom plug connector. In one embodiment, the bottom plug connector may be substantially identical to the top plug connector, but located on the opposite, or bottom, edge of the terminal block. Furthermore, a third terminal block may also include a bottom plug connector, wherein a first connector of a second expansion plug may be operable to couple to the bottom plug connector of the second terminal block, and a second connector of the second expansion plug may be operable to couple to the bottom plug connector of the third terminal block. Thus, the second expansion plug may be operable to electrically couple the second terminal block to the third terminal block via the respective bottom plug connectors of each terminal block.

In a preferred embodiment, each terminal block may include both a top plug connector and a bottom plug connector so that each terminal block may be coupled to a neighboring terminal block via an expansion plug using either top plug connectors or bottom plug connectors.

In one embodiment, each terminal block may implement at least a portion of a switch matrix, such that the first terminal block implements at least a portion of a first switch matrix, and the second terminal block implements at least a portion of a second switch matrix. The expansion plug may be operable to electrically couple the portion of the first switch matrix to the portion of the second switch matrix to form at least a portion of a third switch matrix, wherein the portion of the third switch matrix comprises at least a portion of an integrated switch matrix comprising the portions of the first and second switch matrices.

In one embodiment, the chassis may be operable to receive a plurality of switching modules into respective slots of the chassis. In one embodiment, one or more of the plurality of switching modules may comprise signal conditioning modules. In one embodiment, a plurality of terminal blocks may each be operable to couple to respective ones of the plurality of switching modules. In one embodiment, each terminal block/switching module pair may comprise a switching matrix, such that the first terminal block and the first switching module together comprise a first switch matrix, the second terminal block and the second switching module together comprise a second switch matrix, and so on.

A plurality of expansion plugs may couple each adjacent pair of terminal blocks in the manner described above. More specifically, the first expansion plug may electrically couple the first switch matrix to the second switch matrix to form the third switch matrix, wherein the third switch matrix comprises the integrated switch matrix comprising the first and second switch matrices. Similarly, the second expansion plug may electrically couple the second terminal block (with the second module) and the third terminal block (with the third module), thereby integrating the switch matrix comprised by the third terminal block and module into the integrated third switch matrix.

It should be noted that in the preferred embodiment, successive terminal block pairs are coupled via top and bottom plug connectors in an alternating manner. For example, the first terminal block may be coupled to the second terminal block via top plug connectors, the second terminal block may be coupled to the third terminal block via bottom plug connectors, the third terminal block may be coupled to the fourth terminal block via top plug connectors, and so on. Thus, in one embodiment, the plug connector pairs used to couple consecutive pairs of terminal blocks may alternate in a top, bottom, top, bottom, etc., manner. Thus, any number of terminal block/module pairs may be coupled together via expansion plugs in an interleaved manner, such that a plurality of switch matrices corresponding to a plurality of terminal block/switching modules may be integrated into a single integrated switch matrix.

Thus, using the system described above, a plurality of terminal blocks (with corresponding switching modules) may be coupled together via expansion plugs until a switch matrix of the desired size is formed.

BRIEF DESCRIPTION OF THE DRAWINGS

A better understanding of the present invention can be obtained when the following detailed description is considered in conjunction with the following drawings, in which.

Figure 1:
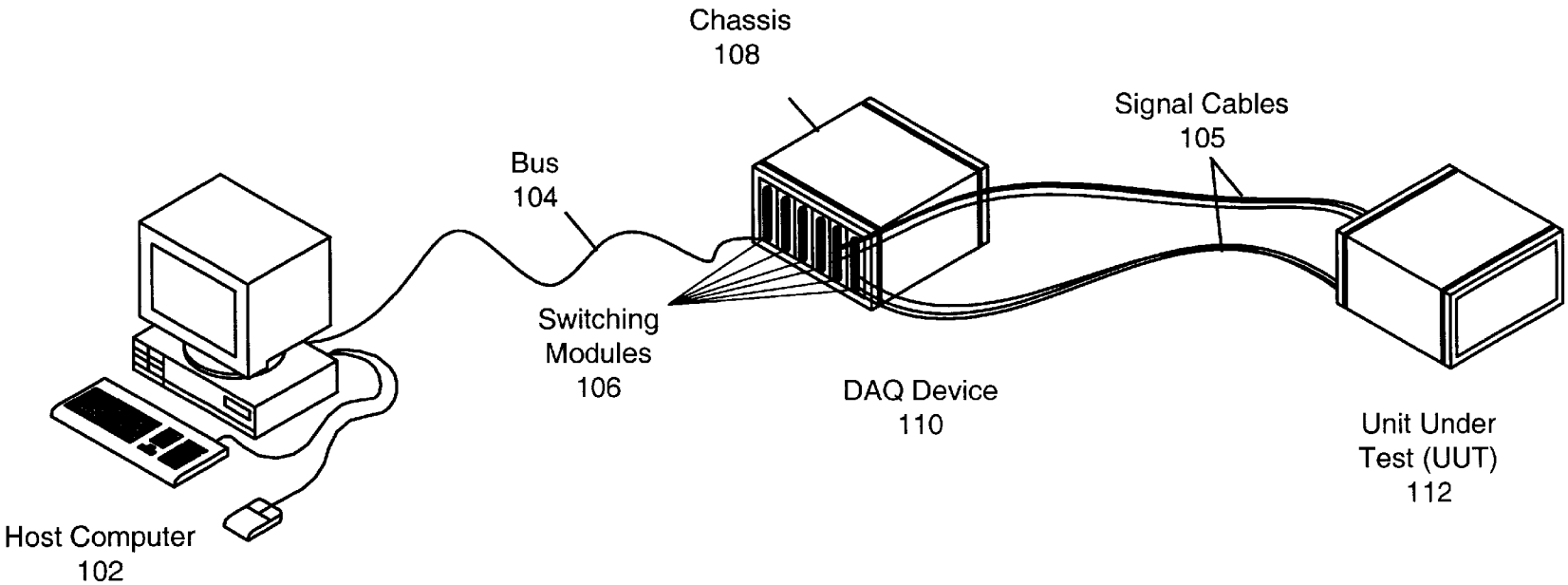
FIG. 1 illustrates a data acquisition system, according to one embodiment.

While the invention is susceptible to various modifications and alternative forms, specific embodiments are shown by way of example in the drawings and will herein be described in detail. It should be understood however, that drawings and detailed descriptions thereto are not intended to limit the invention to the particular forms disclosed. But on the contrary the invention is to cover all modifications, equivalents and alternatives following within the spirit and scope of the present invention as defined by the appended claims.

DETAILED DESCRIPTION OF THE PREFERRED EMBODIMENT

FIG. 1: A Data Acquisition System

FIG. 1 illustrates a data acquisition (DAQ) system, according to one embodiment. As FIG. 1 shows, a host computer system 102 may be coupled to a data acquisition, measurement, or signal conditioning device 110, such as a signal conditioner, via a bus 104. The DAQ device 110 may be further coupled to a Unit Under Test (UUT) 112 via one or more signal cables 105. It should be noted that the use of the signal conditioner 110 in describing the present embodiment is for illustrative purposes only, and is not intended to limit the use of the present invention to any particular data acquisition/measurement device or peripheral. Rather, the present invention is intended to operate in any system which uses a plurality of terminal blocks coupled to a corresponding plurality of switching modules.

In one embodiment, the host computer system 102 may include DAQ hardware, such as a DAQ board or card, which may be operable to receive analog signals from an external source and convert the analog signals into digital form for storage, presentation, and/or analysis by the host computer system 102. The DAQ board or card may thus couple to the signal conditioning device 110.

In one embodiment, the DAQ device 110 may comprise a chassis 108 which may be operable to receive one or more inserted switching modules 106. Each of the switching modules may be operable to receive analog signals from the UUT 112 and to condition the analog signals into a form suitable for transmission to the DAQ hardware in the host computer system 102. In one embodiment, the DAQ device 110 may comprise a National Instruments SCXI (Signal Conditioning eXtensions for Instrumentation) signal conditioner 110, wherein the terminal blocks comprise SCXI terminal blocks, and wherein the switching modules 106 comprise SCXI modules.

In a preferred embodiment, a terminal block may be coupled to each switching module 106 to provide I/O connections. For example, a terminal block may provide a plurality of screw connections, spring connections, or other connections for connecting to signal wires from an external signal source. The terminal block may also include a module connector for coupling to the switching module contained in the chassis 108. The combination of the terminal block and the switching module may comprise a switch matrix which may be configurable to provide a plurality of signal paths for input and output signals.

Switch Matrix

A switch matrix provides a clean, simple way to route or interconnect signal paths between a large number of inputs and outputs without the use of wires or cables. A switch matrix typically comprises a set of inputs organized into N rows and outputs organized into M columns. The switches inside a matrix make it possible to route any input signal coming from the N rows to any of the M output columns. In one embodiment, a switch matrix may be comprised in a module, such as the switching modules described above, containing switches or relays, and a terminal block which attaches to the module and which provides I/O terminals for receiving signal wires or cables. The switches comprised in the module may be programmed to configure the switch matrix for a desired functionality, i.e., for a desired configuration of signal paths. As mentioned above, in DAQ systems where the number of desired inputs is greater than the number of I/O connections or terminals available on a single terminal block (or switch matrix), two or more terminal blocks (and therefore, modules) may be "daisy-chained" together to act as a single integrated switch matrix. In this way, input signals may be routed to and from any of the interconnected modules. Such chaining may be accomplished without interconnecting wires or cables through the use of an expansion plug, described below.

Figure 2:
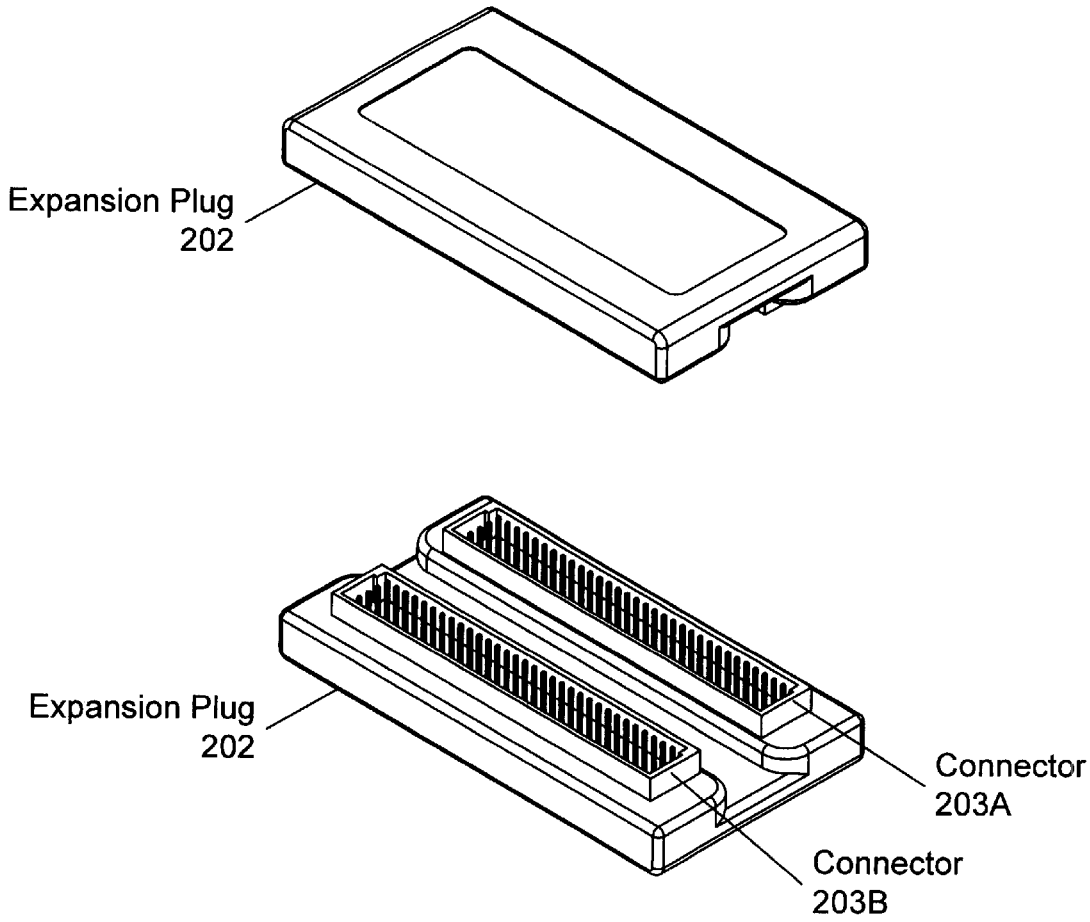
FIG. 2 illustrates an expansion plug, according to one embodiment.

FIG. 2: An Expansion Plug

FIG. 2 illustrates top and bottom views of an expansion plug 202, according to one embodiment. As FIG. 2 shows, in a preferred embodiment, the expansion plug 202 may include a housing which has a rectangular form factor, with at least two connectors comprised on one side of the expansion plug 202. In other embodiments the expansion plug 202 may have other form factors, such as a square, oval, or any other suitable form factor. As can be seen in FIG. 2, in one embodiment the expansion plug 202 (housing) may have a shallow profile, i.e., the expansion plug 202 may require little or no additional vertical space when installed, as shown in more detail in FIGS. 3 and 4 below. In the preferred embodiment, the expansion plug's low profile accommodates rack-mount installation of the chassis 108 in that substantially no extra vertical rack space is required for the expansion plug 202, i.e., in the preferred embodiment, the installed expansion plug 202 is within the physical envelope of the chassis/terminal block assembly. Thus, chassis/terminal block assemblies may be stacked (such as in a rack mount) without requiring extra vertical space for installed expansion plugs. In one embodiment, the expansion plug may have a height between 0.2 inches and 0.6 inches, a width between 1 inch and 3 inches, and a length (depth) between 1 inch and 5 inches. Note that as used herein, the expansion plug height refers to the vertical dimension of the expansion plug, and the width refers to the front horizontal dimension of the expansion plug. In another embodiment, the expansion plug may have a height between 0.3 inches and 0.5 inches, a width between 1.4 inches and 2.5 inches, and a length (depth) between 3 inches and 4.5 inches. In a preferred embodiment, the expansion plug may have a height of approximately 0.4 inches, a width of approximately 2.25 inches, and a length (depth) of approximately 4.25 inches.

As can be seen in the illustration of expansion plug 202, in one embodiment, each expansion plug 202 may include a first connector, such as 203A, and a second connector, such as 203B, which are electrically connected to each other, and which may be operable to couple the expansion plug 202 to two adjacent terminal blocks, as described below with reference to FIGS. 3A, 3B, and 4.

In one embodiment, the expansion plug housing may include a first surface, wherein the first connector 203A and the second connector 203B are disposed on the first surface of the expansion plug housing. In another embodiment, the expansion plug housing may include a second surface which is opposite the first surface, wherein the first connector 203A is disposed on the first surface of the expansion plug housing and the second connector 203B is disposed on the second surface of the expansion plug housing.

Figure 3A:
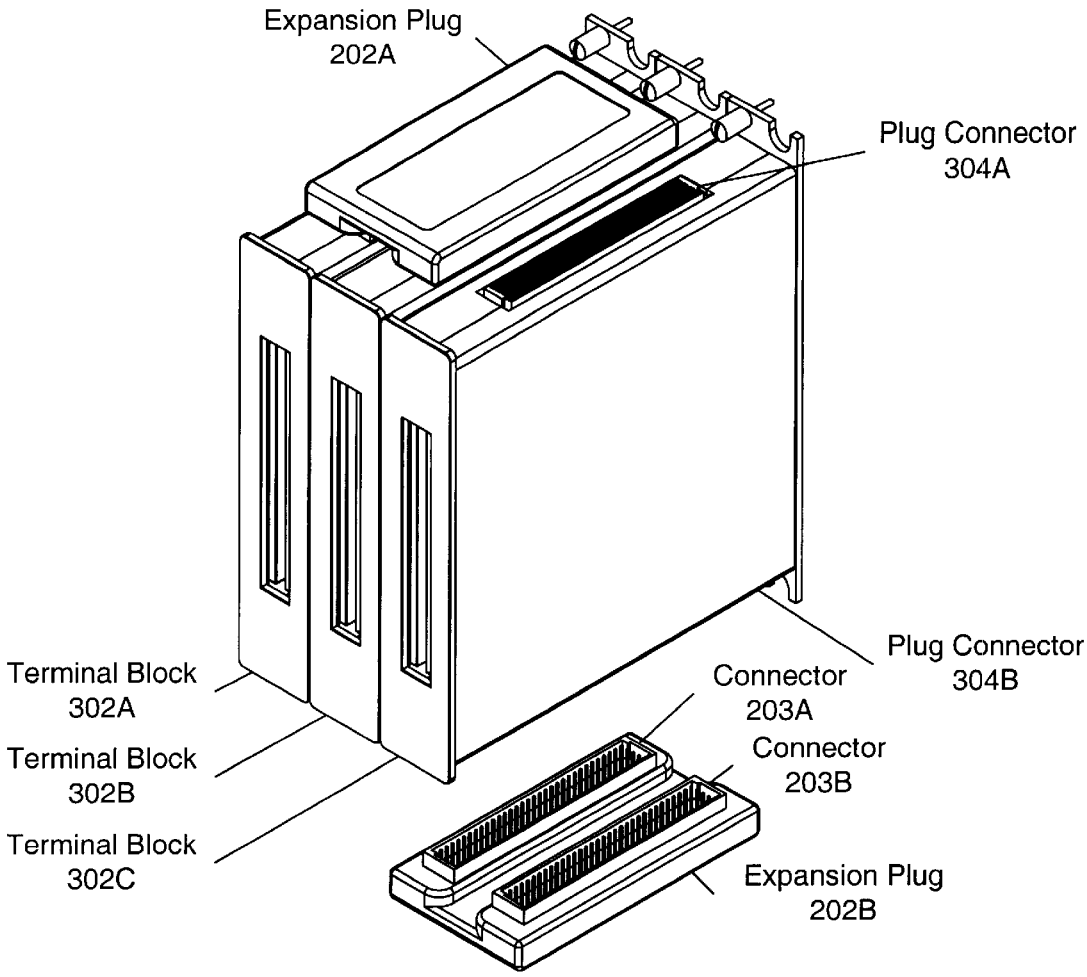
FIG. 3A illustrates an expansion plug coupling two terminal blocks, according to one embodiment.
Figure 3B:
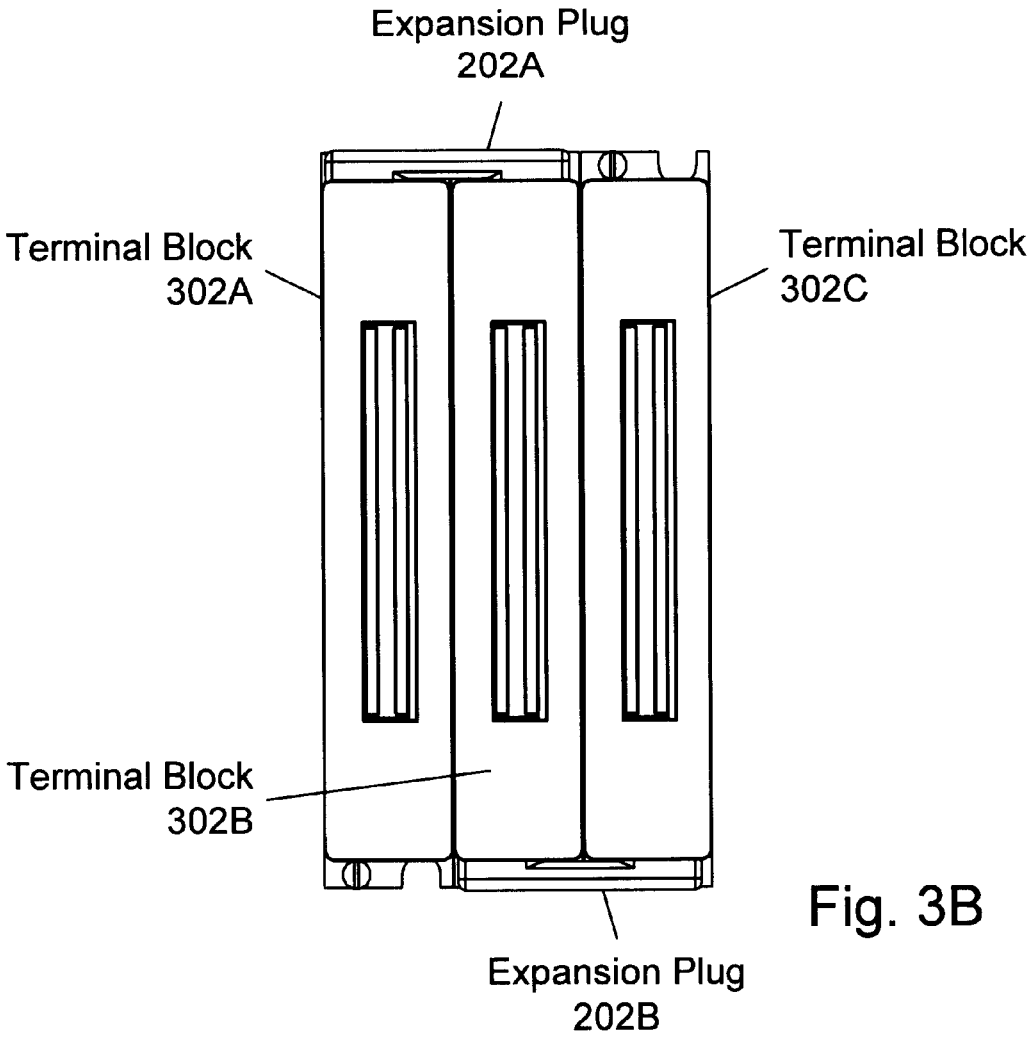
FIG. 3B is a profile view of the system of FIG. 3A.

FIGS. 3A and 3B: Coupling Multiple Terminal Blocks

FIGS. 3A and 3B illustrate the coupling of terminal blocks via an expansion plug, according to one embodiment.

FIG. 3A: An Expansion Plug Coupling Two Terminal Blocks

FIG. 3A illustrates the coupling of a plurality of terminal blocks using one or more expansion plugs. As FIG. 3A shows, a first terminal block 302A and an adjacent second terminal block 302B may be coupled together by expansion plug 202A. Each of the terminal blocks 302 may include at least one plug connector 304 which is operable to couple to one of the two connectors 203 of the expansion plug 202.

In one embodiment, the first terminal block 302A may comprise a first plurality of column connections, and the second terminal block 302B may comprise a second plurality of column connections. The expansion plug 202A may be operable to electrically couple the first terminal block 302A to the second terminal block 302B wherein each of the first plurality of column connections is electrically coupled to a corresponding one of the second plurality of column connections. Thus, the expansion plug 202A may be operable to couple the first and second terminal blocks 302 via the respective column connections of each terminal block.

In another embodiment, the first terminal block 302A may comprise a first plurality of row connections, and the second terminal block 302B may comprise a second plurality of row connections. The expansion plug 202A may be operable to electrically couple the first terminal block 302A to the second terminal block 302B wherein each of the first plurality of row connections is electrically coupled to a corresponding one of the second plurality of row connections. Thus, the expansion plug 202A may be operable to couple the first and second terminal blocks 302 via the respective row connections of each terminal block.

In one embodiment, the plug connectors 304 of the first and second terminal blocks 302 may comprise top plug connectors (such as top plug connector 304A shown on terminal block 302C). In this embodiment, as shown in FIG. 3A, the first connector 203A of the expansion plug 202A is operable to couple to the top plug connector of the first terminal block 302A; and the second connector 203B of the expansion plug 202A is operable to couple to the top plug connector of the second terminal block 302B. Note that in FIG. 3A, the connectors 203 of the expansion plug 202A and the (top) plug connectors of the first and second terminal blocks 302A and 302B are obscured by the expansion plug 202A.

In one embodiment, the second terminal block 302B may also include a bottom plug connector. The bottom plug connector may be identical to the top plug connector, but located on the opposite side of the terminal block 302B. Furthermore, a third terminal block 302C may also include a bottom plug connector 304B, wherein the first connector of the second expansion plug 202B may be operable to couple to the bottom plug connector 304 of the second terminal block 302B, and wherein the second connector of the second expansion plug 202B is operable to couple to the bottom plug connector 304 of the third terminal block 302C. Thus, the second expansion plug 202B may be operable to electrically couple the second terminal block 302B to the third terminal block 302C via the respective bottom plug connectors 304 of each terminal block. In this manner, the two expansion plugs 202A and 202B may be operable to electrically interconnect the three terminal blocks 302A, 302B, and 302C.

In an alternate embodiment, the first terminal block 302A may include a bottom plug connector 304 and the second terminal block 302B may also include a bottom plug connector 304. The first expansion plug 202A may be operable to couple the first terminal block 302A and the second terminal block 302B via the bottom plug connector on each terminal block. In a further embodiment, the second terminal block 302B may also include a top plug connector 304. The third terminal block 302C may include a top plug connector as well. The second expansion plug 202B may be operable to electrically couple the second terminal block 302B to the third terminal block 302C via the respective top plug connectors 304 of each terminal block.

In a preferred embodiment, each terminal block 302 may include both a top plug connector 304 and a bottom plug connector 304 so that each terminal block 302 may be coupled to a neighboring terminal block via an expansion plug 202 using either top plug connectors or bottom plug connectors.

FIG. 3B: Profile of Terminal Blocks Coupled Via Expansion Plugs

FIG. 3B is a profile view of the system described above with reference to FIG. 3A, according to one embodiment. As FIG. 3B shows, the first terminal block 302A may be coupled to the second terminal block 302B via the first expansion plug 202A. In this embodiment, expansion plug 202A is coupled to the first and second terminal blocks via the top plug connector 203 of each terminal block 302. In a similar manner, as shown in FIG. 3B, the second terminal block 302B may also be coupled to the third terminal block 302C via the second expansion plug 202B. In this embodiment, expansion plug 202B is coupled to the second and third terminal blocks via the bottom plug connector 203 of each terminal block 302. Thus, the two expansion plugs 202 may be operable to electrically couple the first, second, and third terminal blocks 302A–C together.

In one embodiment, each terminal block 302 may implement at least a portion of a switch matrix, such that the first terminal block 302A implements at least a portion of a first switch matrix, and the second terminal block 302B implements at least a portion of a second switch matrix. The expansion plug 202 may be operable to electrically couple the portion of the first switch matrix to the portion of the second switch matrix to form at least a portion of a third switch matrix, wherein the portion of the third switch matrix comprises at least a portion of an integrated switch matrix comprising the portions of the first and second switch matrices.

As mentioned above, in various embodiments the present invention provides a mechanism whereby terminal blocks may be coupled together without requiring additional vertical space for the assembly. As may be seen in FIG. 3B, when the expansion plugs 202 are installed on the terminal blocks 302, both expansion plugs 202 remain substantially within the gross physical envelope of the terminal block assembly. This feature is particularly useful when the assembly is part of a rack mounted system because no additional rack space is required when employing the present invention.

Figure 4:
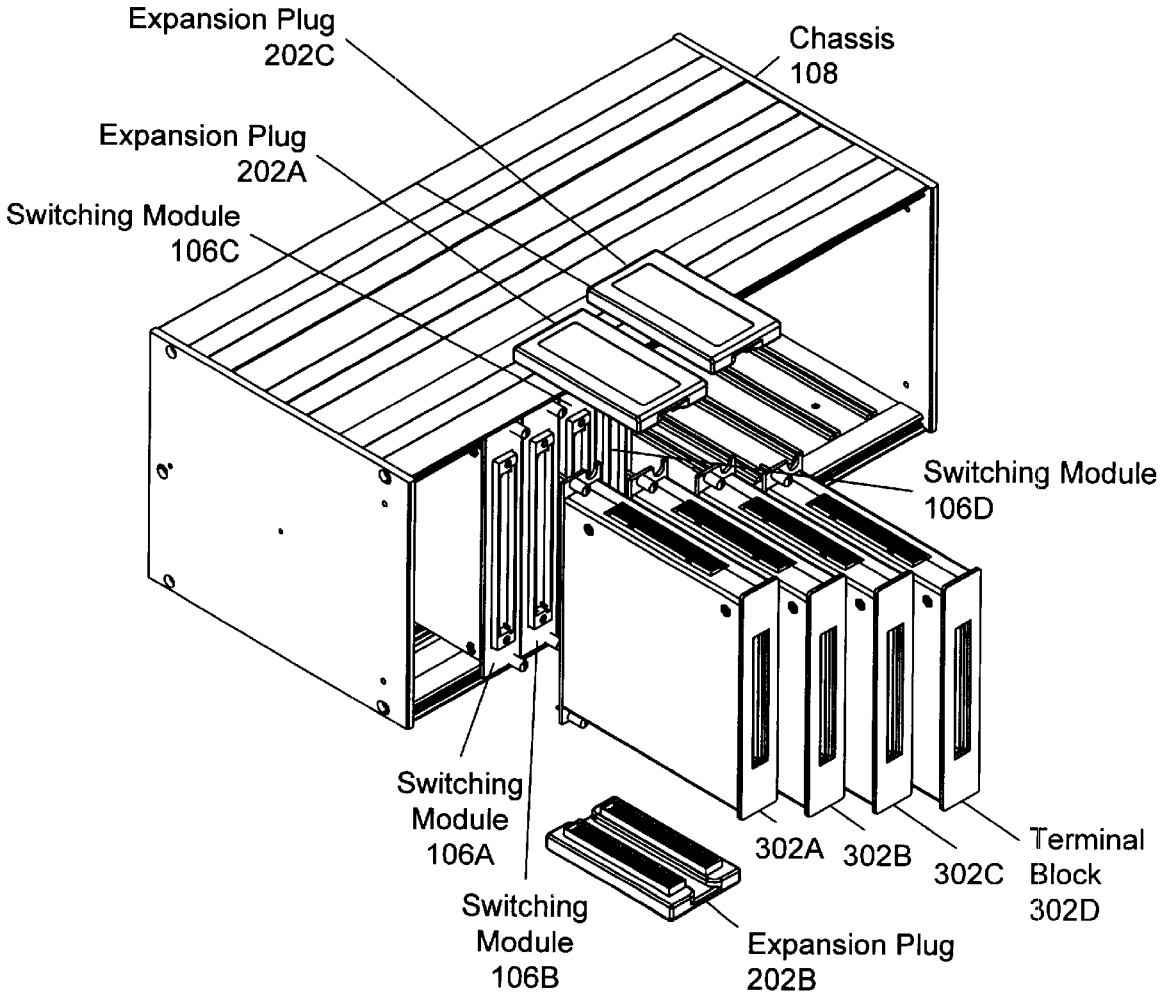
FIG. 4 illustrates a switching system with multiple expansion plugs, according to one embodiment.

FIG. 4: A Switching System With Multiple Expansion Plugs

FIG. 4 illustrates a switching system which uses multiple expansion plugs to couple a plurality of terminal blocks. As FIG. 4 shows, chassis 108 may be operable to receive a plurality of switching modules 106A–D into respective slots of the chassis 108. In one embodiment, one or more of the plurality of switching modules 106 may comprise signal conditioning modules, such as National Instruments SCXI signal conditioning modules. As shown, in one embodiment, a plurality of terminal blocks 302A–D may each be operable to couple to respective ones of the plurality of switching modules 106. In one embodiment, each terminal block/switching module pair may comprise a switching matrix, such that the first terminal block 202A and the first switching module 106A together comprise a first switch matrix, the second terminal block 202B and the second switching module 106B together comprise a second switch matrix, and so on.

A plurality of expansion plugs 202 may be operable to couple each adjacent pair of terminal blocks 302 in the manner described above with reference to FIGS. 3A and 3B. More specifically, the first expansion plug 202A may be operable to electrically couple the first switch matrix to the second switch matrix to form the third switch matrix, wherein the third switch matrix comprises the integrated switch matrix comprising the first and second switch matrices. Similarly, the second expansion plug 202B may be operable to electrically couple the second terminal block 302B (with module 106B) and the third terminal block 302C (with module 106C), thereby integrating the switch matrix comprised by the third terminal block 302C and module 106C into the integrated third switch matrix.

It should be noted that in the preferred embodiment, successive terminal block pairs are coupled via top and bottom plug connectors in an alternating manner. For example, as FIG. 4 shows, the first terminal block 302A may be coupled to the second terminal block 302B via top plug connectors, the second terminal block 302B may be coupled to the third terminal block 302C via bottom plug connectors, the third terminal block 302C may be coupled to the fourth terminal block 302D via top plug connectors, and so on. Thus, in one embodiment, the top and bottom plug connector 203 pairs used to couple consecutive pairs of terminal blocks 302 may alternate in a top, bottom, top, bottom, etc., manner. In another embodiment, the sequence of top and bottom plug connector 203 pairs used to couple consecutive pairs of terminal blocks 302 may begin with a bottom plug connector pair, and proceed in a manner of bottom, top, bottom, top, etc. Thus, any number of terminal block/module pairs may be coupled together via expansion plugs in an interleaved manner, such that a plurality of switch matrices corresponding to a plurality of terminal block/switching module pairs may be integrated into a single integrated switch matrix.

Stated another way, a switching apparatus comprising plurality N of terminal blocks 302 and plurality N−1 of expansion plugs 202, may be formed by coupling successive pairs of the plurality N of terminal blocks 302 using each of the plurality N−1 of expansion plugs, thereby electrically coupling the plurality N of terminal blocks. In other words, each of the plurality N−1 of expansion plugs 202 is operable to couple a set of neighboring terminal blocks of the plurality N of terminal blocks 302. Furthermore, in one embodiment, each of the plurality N of terminal blocks 302 may include top and bottom plug connectors 203, wherein each of the plurality N−1 of expansion plugs 202 is operable to couple a set of neighboring terminal blocks 302 using one of a set of top plug connectors 203 or bottom plug connectors 203 of the neighboring terminal blocks 302, and wherein the top plug connectors 203 and bottom plug connectors 203 of the terminal blocks 302 are used in an interleaved fashion.

Thus, using the apparatus described above with reference to FIGS. 3A, 3B, and 4, a plurality of terminal blocks may be coupled by coupling an expansion plug to a first terminal block, and coupling the expansion plug to a second terminal block, wherein the second terminal block is adjacent to the first terminal block. Additional terminal blocks may be connected by coupling additional expansion plugs respectively to successive pairs of the additional terminal blocks, until a switch matrix of the desired size is formed.

Thus, the present invention provides a way to electrically couple a plurality of terminal blocks together without requiring wires or cables, thereby providing a simple and clean coupling interface. Thus, the present invention provides a way to integrate multiple switch matrices into a single integrated switch matrix. Furthermore, the present invention may be employed without requiring additional vertical space for the assembly.

Although the system and method of the present invention has been described in connection with specific embodiments, it is not intended to be limited to the specific forms set forth herein, but on the contrary, it is intended to cover such alternatives, modifications, and equivalents, as can be reasonably included within the spirit and scope of the invention as defined by the appended claims.

What is claimed is:

1. An apparatus, comprising:

a first terminal block;

a second terminal block; and an expansion plug, wherein the expansion plug comprises:

a housing, wherein the housing comprises a first connector and a second connector, and wherein the first and second connectors are electrically connected;

wherein the first terminal block is operable to couple first module, and wherein the second terminal block is operable to couple to a second switching module;

wherein the first connector is operable to directly connect to the first terminal block, and wherein the second connector is operable to directly connect to the second terminal block; and wherein the expansion plug is operable to electrically couple the first terminal block to the second terminal block in order to route or interconnect a plurality of signal paths.

2. The apparatus of claim 1, wherein the first terminal block comprises a first plurality of column connections;

wherein the second terminal block comprises a second plurality of column connections; and wherein the expansion plug is operable to electrically couple the first terminal block to the second terminal block such that each of the first plurality of column connections is electrically coupled to a corresponding one of the second plurality of column connections.

3. The apparatus of claim 1, wherein the first terminal block comprises a first plurality of row connections;

wherein the second terminal block comprises a second plurality of row connections; and wherein the expansion plug is operable to electrically couple the first terminal block to the second terminal block such that each of the first plurality of row connections is electrically coupled to a corresponding one of the second plurality of row connections.

4. The apparatus of claim 1, wherein the housing has a shallow profile.

5. The apparatus of claim 1, wherein the apparatus is at least partially comprised in a chassis; and wherein, when the expansion plug is coupled to the first and second terminal blocks, the expansion plug does not extend vertically beyond the chassis.

6. The apparatus of claim 1, wherein the first terminal block includes a top plug connector;

wherein the second terminal block includes a top plug connector;

wherein the first connector is operable to couple to the top plug connector of the first terminal block; and wherein the second connector is operable to couple to the top plug connector of the second terminal block.

7. The apparatus of claim 6, wherein the second terminal block also includes a bottom plug connector;

the apparatus further comprising;

a third terminal block, wherein the third terminal block includes a bottom plug connector; and a second expansion plug, wherein the second expansion plug comprises a housing, wherein the housing comprises a first connector and a second connector;

wherein the first connector of the second expansion plug is operable to couple to the bottom plug connector of the second terminal block, and wherein the second connector of the second expansion plug is operable to couple to the bottom plug connector of the third terminal block; and wherein the second expansion plug is operable to electrically couple the second terminal block to the third terminal block.

8. The apparatus claim 1, wherein the first terminal block includes a bottom plug connector;

wherein the second terminal block includes a bottom plug connector;

wherein the first connector is operable to couple to the bottom plug connector of the first terminal block; and wherein the second connector is operable to couple to the bottom plug connector of the second terminal block.

9. The apparatus of claim 8, wherein the second terminal block also includes a top plug connector;

the apparatus further comprising:

a third terminal block, wherein the third terminal block includes a top plug connector; and a second expansion plug, wherein the second expansion plug comprises a housing, wherein the housing comprises a first connector and a second connector;

wherein the first connector of the second expansion plug is operable to couple to the top plug connector of the second terminal block, and wherein the second connector of the second expansion plug is operable to couple to the top plug connector of the third terminal block; and wherein the second expansion plug is operable to electrically couple the second terminal block to the third terminal block.

10. The apparatus of claim 8, wherein the first terminal block implements at least a portion of a first switch matrix;

wherein the second terminal block implements at least a portion of a second switch matrix; and wherein the expansion plug is operable to electrically couple the at least a portion of the first switch matrix to the at least a portion of the second switch matrix to form at least a portion of a third switch matrix, and wherein the at least a portion or the third switch matrix comprises at least a portion of an integrated switch matrix comprising the at least a portion of the first and second switch matrices.

11. The apparatus of claim 1, wherein the expansion plug housing includes a first surface, and wherein the first connector and the second connector are disposed on the first surface of the expansion plug housing.

12. An expansion plug apparatus for connecting a first terminal block and a second terminal block, the expansion plug apparatus comprising:

a housing;

a first connector disposed on a first side of the housing; and a second connector disposed on the first side of the housing;

wherein the first and second connectors arc electrically connected;

wherein the first terminal block is operable to couple to a first switching module, and wherein the second terminal block is operable to couple to a second switching module;

wherein the first connector is operable to directly connect couple to the first terminal block, and wherein the second connector is operable to directly connect couple to the second terminal block; and wherein the expansion plug apparatus is operable to electrically couple the first terminal block to the second terminal block in order to route or interconnect a plurality of signal paths.

13. The expansion plug apparatus of claim 12, wherein the housing has a height not greater than 0.6 inches.

14. The expansion plug apparatus of claim 12, wherein the housing has a width not greater than 3 inches.

15. The expansion plug apparatus of claim 12, wherein the housing has a shallow profile.

16. The expansion plug apparatus of claim 12, wherein the first and second terminal blocks are operable to couple to a chassis; and wherein, when the expansion plug apparatus is coupled to the first and second terminal blocks, the expansion plug apparatus does not extend vertically beyond the chassis.

17. The expansion plug apparatus of claim 12, wherein the first terminal block comprises a first plurality of column connections;

wherein the second terminal block comprises a second plurality of column connections; and wherein the expansion plug apparatus is operable to electrically couple the first terminal block to the second terminal block such that each of the first plurality of column connections is electrically coupled to a corresponding one of the second plurality of column connections.

18. The expansion plug apparatus of claim 12, wherein the first terminal block comprises a first plurality of row connections;

wherein the second terminal block comprises a second plurality of row connections; and wherein the expansion plug apparatus is operable to electrically couple the first terminal block to the second terminal block such that each of the first plurality of row connections is electrically coupled to a corresponding one of the second plurality of row connections.

19. The expansion plug apparatus of claim 12, wherein the first terminal block includes a top plug connector;

wherein the second terminal block includes a top plug connector;

wherein the first connector is operable to couple to the top plug connector of the first terminal block; and wherein the second connector is operable to couple to the top plug connector of the second terminal block.

20. The expansion plug apparatus of claim 19, wherein the second terminal block also includes a bottom plug connector, wherein a second expansion plug apparatus is operable to connect the second terminal block to a third terminal block, wherein the third terminal block includes a bottom plug connector; and wherein the second expansion plug apparatus comprises a housing, wherein the housing comprises a first connector and a second connector;

wherein the first connector of the second expansion plug apparatus is operable to couple to the bottom plug connector of the second terminal block, and wherein the second connector of the second expansion plug apparatus is operable to couple to the bottom plug connector of the third terminal block; and wherein the second expansion plug apparatus is operable to electrically couple the second terminal block to the third terminal block.

21. The expansion plug apparatus of claim 12, wherein the first terminal block includes a bottom plug connector;

wherein the second terminal block includes a bottom plug connector;

wherein the first connector is operable to couple to the bottom plug connector of the first terminal block; and wherein the second connector is operable to couple to the bottom plug connector of the second terminal block.

22. The expansion plug apparatus of claim 21, wherein a second expansion plug apparatus is operable to connect the second terminal block to a third terminal block, wherein the second terminal block also includes a top plug connector, wherein the third terminal block includes a top plug connector;

wherein the second expansion plug apparatus comprises a housing, wherein the housing comprises a first connector and a second connector;

wherein the first connector of the second expansion plug apparatus is operable to couple to the top plug connector of the second terminal block, and wherein the second connector of the second expansion plug apparatus is operable to couple to the top plug connector or the third terminal block; and wherein the second expansion plug apparatus is operable to electrically couple the second terminal block to the third terminal block.

23. The expansion plug apparatus or claim 12, wherein the first terminal block implements at least a portion of a first switch matrix;

wherein the second terminal block implements at least a portion of a second switch matrix; and wherein the expansion plug apparatus is operable to electrically couple the at least a portion or the first switch matrix to the at least a portion of the second switch matrix to form at least a portion or a third switch matrix, and wherein the at least a portion of the third switch matrix comprises at least a portion of an integrated switch matrix comprising the at least a portion of the first and second switch matrices.

24. The expansion plug apparatus of claim 12, wherein the housing includes a first surface, and wherein the first connector and the second connector are disposed on the first surface of the housing.

25. A switching apparatus, comprising:

a first terminal block which implements at least a portion of a first switch matrix;

a second terminal block which implements at least a portion of a second switch matrix; and an expansion plug, wherein the expansion plug comprises:

a housing, wherein the housing comprises a first connector and a second connector, and wherein the first and second connectors are electrically connected;

wherein the first connector is operable to directly connect to the first terminal block, and wherein the second connector is operable to directly connect to the second terminal block;

wherein the first terminal block is operable to couple to a first switching module, and wherein the second terminal block is operable to couple to a second switching module;

wherein the expansion plug is operable to electrically couple the at least a portion of the first switch matrix to the at least a portion of the second switch matrix to form at least a portion of a third switch matrix in order to route or interconnect a plurality of signal paths, and wherein the at least a portion of the third switch matrix comprises at least a portion of an integrated switch matrix comprising the at least a portion of the first and second switch matrices.

26. The switching apparatus of claim 25, wherein the expansion plug housing includes a first surface, and wherein the first connector and the second connector are disposed on the first surface of the expansion plug housing.

27. The switching apparatus of claim 25, wherein the first terminal block and the first switching module comprise the first switch matrix;

wherein the second terminal block and the second switching module comprise the second switch matrix; and wherein the expansion plug is operable to electrically couple the first switch matrix to the second switch matrix to form the third switch matrix, and wherein the third switch matrix comprises the integrated switch matrix comprising the first and second switch matrices.

28. A switching apparatus, comprising:

a plurality N of terminal blocks; and a plurality N−1 of expansion plugs, wherein each expansion plug comprises:

a housing, wherein the housing comprises a first connector and a second connector, and wherein the first and second connectors are electrically connected;

wherein the first connector is operable to directly connect to a first terminal block of the plurality N of terminal blocks, and wherein the second connector is operable to direct connect to a second terminal block of the N terminal blocks;

wherein each terminal block in the plurality N of terminal blocks are operable to couple to at least one switching module; and wherein the plurality N−1 of expansion plugs are operable to electrically couple the N terminal blocks in order to route or interconnect a plurality of signal paths.

29. The switching apparatus of claim 28, wherein each expansion plug is operable to electrically couple a first terminal block of the plurality N of terminal blocks to a second terminal block of the plurality N of terminal blocks.

30. The switching apparatus of claim 28, wherein each of the plurality N−1 of expansion plugs is operable to couple a set of neighboring terminal blocks.

31. The switching apparatus of claim 30, wherein each of the plurality N of terminal blocks includes top and bottom plug connectors;

wherein each of the plurality N−1 of expansion plugs is operable to couple a set of neighboring terminal blocks using one of a set of top plug connectors or bottom plug connectors of the neighboring terminal blocks; and wherein the top plug connectors and bottom plug connectors of the terminal blocks are used in an interleaved fashion.

32. An apparatus for connecting a plurality of terminal blocks, the apparatus comprising:

a housing, wherein the housing comprises a first connector and a second connector, and wherein the first and second connectors arc electrically connected;

wherein the first connector is operable to directly connect to a first terminal block, and wherein the second connector is operable to directly connect to a second terminal block;

wherein the first terminal block is operable to couple to a first switching module, and wherein the second terminal block is operable to couple to a second switching module;

wherein the first terminal block implements at least a portion of a first switch matrix, and wherein the second terminal block implements at least a portion of a second matrix; and wherein the expansion plug is operable to electrically couple the at least a portion of the first switch matrix to the at least a portion of the second switch matrix to form at least a portion of a third switch matrix in order to route or interconnect a plurality of signal paths, and wherein the at least a portion of the third switch matrix comprises at least a portion of an integrated switch matrix comprising the at least a portion of the first and second switch matrices.

33. The apparatus of claim 32, wherein the housing includes a first surface, and wherein the first connector and the second connector are disposed on the first surface of the housing.

34. A method for connecting a plurality of terminal blocks, the method comprising:

directly connecting an expansion plug to a first terminal block; and directly connecting the expansion plug to a second terminal block, wherein the second terminal block is adjacent to the first terminal block;

wherein the expansion plug comprises a housing, wherein the housing comprises a first connector and a second connector, wherein the first and second connectors are electrically connected;

wherein the first terminal block is operable to couple to a first switching module, and wherein the second terminal block is operable to couple to a second switching module;

wherein said directly connecting the expansion plug to the first terminal block comprises directly connecting the first connector to the first terminal block, and wherein said directly connecting the expansion plug to the second terminal block comprises directly connecting coupling the second connector to the second terminal block; and wherein the expansion plug electrically couples the first terminal block to the second terminal block in order to route or interconnect a plurality of signal paths.

35. The method of claim 34, wherein the first terminal block comprises a first plurality of column connections;

wherein the second terminal block comprises a second plurality of column connections; and wherein the expansion plug electrically couples the first terminal block to the second terminal block wherein each of the first plurality of column connections is electrically coupled to a corresponding one of the second plurality of column connections.

36. The method of claim 34, wherein the first terminal block comprises a first plurality of row connections;

wherein the second terminal block comprises a second plurality of row connections; and wherein the expansion plug electrically couples the first terminal block to the second terminal block wherein each of the first plurality of row connections is electrically coupled to a corresponding one of the second plurality of row connections.

37. The method of claim 34, further comprising:

coupling the first terminal block to a first switching module; and coupling the second terminal block to a second switching module;

wherein the first terminal block and the first switching module comprise a first switch matrix;

wherein the second terminal block and the second switching module comprise a second switch matrix; and wherein the expansion plug is operable to electrically couple the first switch matrix to the second switch matrix to form a third switch matrix, and wherein the third switch matrix comprises an integrated switch matrix comprising the first and second switch matrices.

* * * * *

UNITED STATES PATENT AND TRADEMARK OFFICE

CERTIFICATE OF CORRECTION

PATENT NO. : 6,572,403 B2
DATED : June 3, 2003
INVENTOR(S) : Reimund et al.

It is certified that error appears in the above-identified patent and that said Letters Patent is hereby corrected as shown below:

Column 10,
Line 15, please delete “couple first” and substitute -- couple to a first switching --.

Column 11,
Line 55, please delete “at least a portion or” and substitute -- at least a portion of --.

Column 12,
Lines 13 and 14, please delete “couple”.

Column 13,
Line 45, please delete “top plug connector or” and substitute -- top plug connector of --.

Column 14,
Line 55, please delete “operable to direct” and substitute -- operable to directly --.

Column 15,
Line 31, please insert -- switch -- between the words “second” and “matrix”.

Column 16,
Line 12, please delete “coupling”.
Line 40, please delete “to a first” and substitute -- to the first --.
Line 42, please delete “to a second” and substitute -- to the second --.

Signed and Sealed this

Eighteenth Day of November, 2003

JAMES E. ROGAN
*Director of the United States Patent and Trademark Office*